United States Patent [19]

Taylor

[11] 4,205,460

[45] Jun. 3, 1980

[54] APPARATUS FOR DRYING FRUIT

[76] Inventor: William J. Taylor, 1180 E St., Hayward, Calif. 94541

[21] Appl. No.: 927,631

[22] Filed: Jul. 24, 1978

[51] Int. Cl.[2] ..... F26B 9/02; F26B 21/04

[52] U.S. Cl. ..... 34/225; 34/215

[58] Field of Search ..... 426/443, 465; 34/201, 34/209, 210, 211, 212, 215, 218, 219, 224, 225, 231, 232, 233, 197

[56] References Cited

U.S. PATENT DOCUMENTS

| | | | |
|---|---|---|---|
| 528,496 | 10/1894 | Williams | 34/233 |
| 1,319,605 | 10/1919 | Morton | 34/225 |
| 1,527,192 | 2/1925 | Judelson | 34/223 |
| 1,569,880 | 1/1926 | Rees et al. | 34/212 |
| 2,000,103 | 5/1935 | Shodron | 34/225 |
| 2,347,936 | 5/1944 | Crewson | 34/219 |
| 2,736,108 | 2/1956 | Muydesman | 34/212 |
| 3,299,532 | 1/1967 | Melikian | 34/219 |
| 3,600,823 | 12/1968 | Borron | 34/232 |
| 3,910,757 | 10/1975 | Taylor et al. | 34/233 |

*Primary Examiner*—S. Leon Bashore
*Assistant Examiner*—Steve Alvo
*Attorney, Agent, or Firm*—Keith D. Beecher

[57] ABSTRACT

An apparatus for circulating high temperature air at approximately 20,000 cubic feet per minute through an enclosed room in which fruit are stacked in sweat boxes on pallets. A fan draws the heated air from a heat source into a plurality of inlet ports at the bottom of the housing. A damper position at each of the inlet ports deflects the hot air entering the drying room upwardly between the stacks of containers in the drying room and the corresponding side wall of the housing towards said top, the hot air passing between the top of the stacks of containers in the room and the top of the housing, and down between the stacks of containers in the room and the opposite side wall of the housing. A recirculating port in the first-named side wall through which the fan draws the air from the opposite side wall between the individual containers in the stacks and across the fruit within the containers and back to the inlet of said source.

1 Claim, 5 Drawing Figures

APPARATUS FOR DRYING FRUIT

BACKGROUND OF THE INVENTION

The present invention pertains to a method and apparatus for drying fruits, and more particularly, to a method and apparatus that may be used to dry raisins, peaches, figs, nuts, cherries, and the like to have a moisture content of 16% or less, according to U.S. Department of Agriculture standards.

Although the present invention has application in various fruit and nut drying industries, the specific embodiment herein described relates to the application of the present invention in the grape (and, particularly, the raisin) industry. Those skilled in the art will appreciate the advantages in using the present invention in their own particular industries for reducing the moisture content of their fruits or nuts to the point where such fruits or nuts may be successfully stored without rotting.

Prior art raisin drying techniques include the steps of picking the grapes from the vine, allowing the grapes to dry in the sun for a prescribed period of time, "cigaretting" the grapes (that is, wrapping the grapes in paper much in the form of a large cigarette) and allowing the raisins so wrapped to continue to be exposed to the sunlight for a prescribed period of time, and then transferring the partially dried raisins (resulting from these grape-drying steps) to boxes called sweats which are then removed from the field. From the sweats, the partially dried raisins are transferred to trays which are loaded on cars and inserted into a dehydrator, which is much like a wind tunnel into one end of which is blown hot air. Because the end of the dehydrator into which the hot air is blown has a higher temperature than the end from which the hot air exits, regular rotation of the cars containing the trays is necessary to avoid "carmelizing" of the raisins (that is, burning them).

In the prior art technique, however, carmelizing of the raisins nevertheless is a frequent occurrence, and in the transference of the partially dried raisins from the sweats to the trays, a loss of approximately 10% of the raisins occurs. Additionally, the dehydrators of the prior art are costly to purchase, operate and time consuming.

The present invention, on the other hand, includes a method of drying raisins and apparatus therefor which was originally designed with an individual grape grower in mind. It offers the flexibility of a self-contained unit, but requires less manpower to operate. One of the reasons for this advantage is the unique air system which differs completely in principle from the conventional dehydrator-type dryer. In the method and apparatus of the present invention, temperature of an elevated temperature is moved from side to side in a drying room as opposed to the front-to-back movement in the conventional dehydrator. This creates more uniform drying within the drying room. Additionally, the method of the present invention allows the partially dried grapes or raisins to be placed within the drying room in the sweats, rather than transferring the partially dried raisins to trays. In the sweats, and because of the side-to-side movement of the air within the drying room, the raisins within the sweats dry uniformly and are all finished at one time. There is no need to rotate trays in and out of the drying room as is necessary in the prior art dehydrator method. Additionally, a large volume and high velocity of air used in the prior art dehydrator method is substantially reduced, while at the same time allowing for uniform elevated temperatures and more even air penetration of the raisins. This is accomplished within the method and apparatus of the present invention by partially reusing heated air, thus adding fuel savings to its features.

As contrasted with a standard 55 foot prior art raisin dryer, which can hold 15 cars (each car holding 25 trays of 55 pounds of raisins each), the method and apparatus for drying raisins of the present invention of a comparable size holds 30 palletts of sweats, each pallett containing 16 sweats, or a total of 35 tons of raisins. In the method and apparatus of the present invention without rotating or moving the 30 palletts of sweats, the raisins are dried to U.S.D.A. standards within 20 to 24 hours as contrasted with the necessity in the prior art to check the trays of raisins every 2 or 3 hours and rotate them at such intervals, thus accomplishing drying in approximately 24 hours on a warm day.

SUMMARY OF THE INVENTION

In accordance with the present invention, raisins are dried by the method including the steps of picking the grapes from the vine, drying the grapes in the sun, placing the raisins in sweats, placing the sweats in a drying room, and circulating air having a temperature elevated above 120° fahrenheit through and among the sweats for a period of approximately 24 hours. A specially constructed drying room to which is connected a unique air circulating system are provided for maintaining uniform temperature and humidity throughout the drying room.

The novel features which are believed to be characteristic of the present invention, both as to its construction and method of operation, together with further objects and advantages thereof, will be better understood from the following description considered in connection with the accompanying drawings which one embodiment of the invention is illustrated by way of example. It is to be expressly understood, however, that the drawings and description are for the purpose and use of illustration and description only, and are not intended as a definition of the limits of the invention.

DESCRIPTION OF THE PREFERRED EMBODIMENTS

Figure 1:
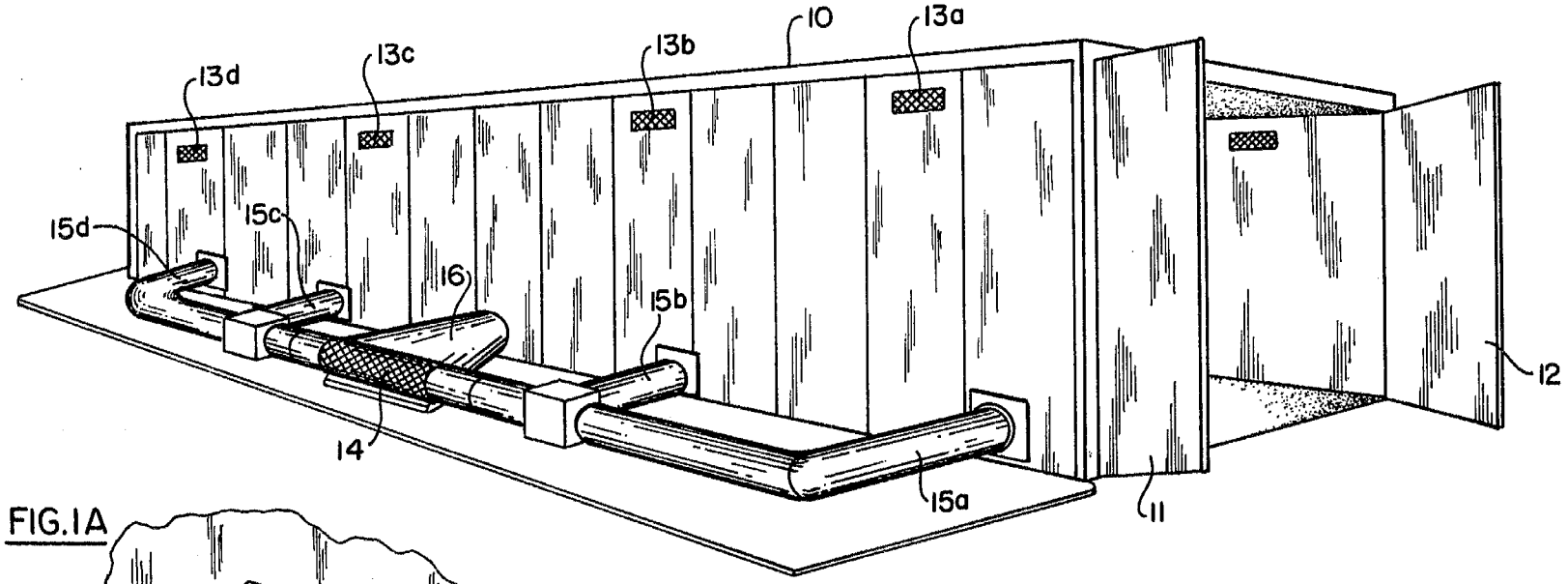
FIG. 1—is a perspective view of a fruit drying apparatus for use with the present invention.
Figure 2:
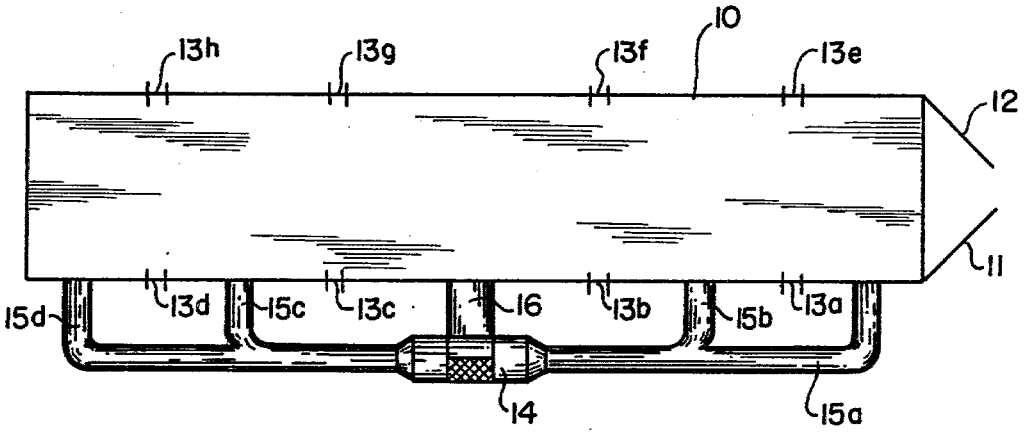
FIG. 2—is a top view of the fruit drying apparatus illustrated in FIG. 1.
Figure 3:
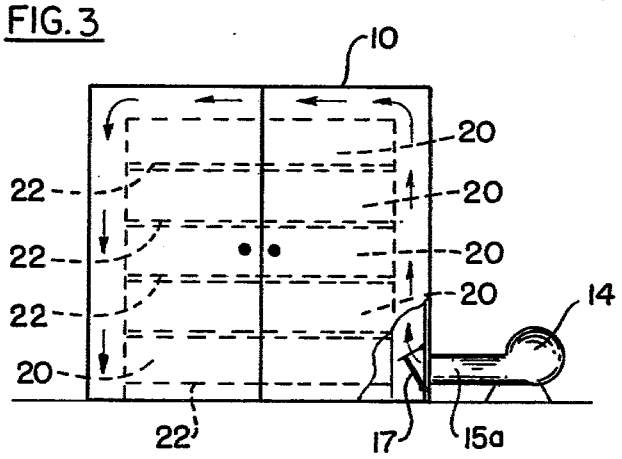
FIG. 3—is an end view of the fruit drying apparatus illustrated in FIG. 1.

With reference to the drawings, FIGS. 1, 2 and 3 illustrate pieces of equipment, fabricated in accordance with the teachings of the present invention, which may be used in practicing the present invention.

FIG. 1 illustrates a perspective view of a drying room 10 having doors 11 and 12 at one end thereof and exhaust ports 13*a*, 13*b*, 13*c*, 13*d*, on the front side thereof, and exhaust ports 13*e*, 13*f*, 13*g* and 13*h* on the backside thereof. A source of high velocity hot air 14 is coupled to the drying room 10 through ducts 15*a*, 15*b*, 15*c* and 15*d*. An exhaust duct 16 from the center of the drying room 10 returns air to the source 14.

Referring now to FIG. 3, the drying room 10 is illustrated as having the source 14 coupled thereto by the ducts, such as duct 15*a*. At the inlet of duct 15*a*, and at the inlet of each of the ducts 15*b*, 15*c* and 15*d*, to the room 10, is a damper 17 (FIG. 1A) that may be adjusted to control the amount of hot air delivered to the drying room 10 by the source 14 and for directing the air upward in the drying room 10. Stacked within the drying room 10 are a plurality of sweats 20 between which are shown gaps or spaces 22 for the passage of air there between.

FIG. 2 illustrates a top view of the apparatus illustrated in FIG. 1. The doors 11 and 12 on one end of the drying room 10 are shown to be partially open. In operation of the equipment illustrated in FIGS. 1, 2 and 3, however, the doors would be closed. With the doors closed, air from the source 14 at an elevated temperature above 120° fahrenheit is propelled through ducts 15*a*, 15*b*, 15*c* and 15*d* into the room 10. As the air is propelled into drying room 10, dampers, such as the damper 17 in FIGS. 1A and 3, deflect the air upward toward the ceiling of the room and the passageway between the top of the sweats 20 and the ceiling of the room 10 allows the air to pass there through toward the opposite side of the room 10 and down between the sweats 20 and the opposite wall. From there, the hot air passes through the gaps or spaces 22 across the top of the sweats in which raisin are located. The air passing through the spaces 22 is then sucked up by the airstream flowing upward along the front wall of the room 10. Some of the air passing between the sweats 22 and the back wall of the room 10, and some of the air passing between the front wall of room 10 and the sweats 20 is vented to the outside through exhaust ports 13*a*–13*h*. Approximately 75% of the air pumped into the drying room 10 is thus vented. The remaining 25% of the now moist air pumped into the drying room 10 is drawn out of the room through duct 16 and back to the source 14 for recirculation. The effect of drawing moist air back to the source 14 while at the same time exhausting moist air to the outside environment of room 10 at uniformly positioned exhaust vents 13*a*, 13*b*, 13*c*, 13*d*, 13*e*, 13*f*, 13*g* and 13*h*, is to cause the air pumped into the room to be uniformly dispersed throughout the room and to be maintained at substantially equal temperatures and humidities throughout the room 10.

The heart of the system of the present invention is the source 14 which can be mechanized in a number of ways as will be recognized in those skilled in the art. Although now shown, the source may include a fan driven by an electric or butane fueled motor. In one embodiment of the invention, a 7-½ horsepower 3-phase motor has been used, and in another embodiment, a 16 horsepower butane-fueled engine has been used. The fan draws air from the duct 16 (approximately 25% of that delivered by the source) and from the outside environment. Such air is propelled into the ducts 15*a*–15*h* by the fan over gas or butane-fueled burners into which an air and gas mixture is supplied by means of, for example, 2 venturis. For example, in the embodiment of the present invention illustrated in FIGS. 1, 2 and 3, approximately 20,000 cubic feet of air per minute is delivered to each of the ducts 15 (which may be, for example, 16-inch galvanized air tunnels). This unit differs from a conventional dryer because in the prior art fruit dehydrators fans are located downstream from the heat source. Air is heated, then pulled by the fan across the burner. Also, in the system illustrated in FIGS. 1, 2 and 3, not as much air is needed to dry the fruit contained within the drying room 10. Moreover, because already heated air is drawn from the drying room 10 through duct 16 and reused, fuel savings are realized as the room interior is heated, thermostatic controls, well known to those skilled in the art, measure the temperature of the air in the drying room 10 and control the amount of heat supplied to the air delivered by source 14.

The drying room 10, graphically illustrated in the drawings, may be typically fabricated of 4 foot × 8 foot, six inch tongue and groove stretch skin panels, that are held together by a 1 × 3 foot wood frame with ⅞ths inch exterior plywood on each side. All external corners of the drying room 10 may be covered, for example, with 20 gauge galvanized steel for strength. The building is designed to sit on any flat surface, and, typically, is 8 foot 6 inches high, 8 feet wide and 52 feet long.

The source 14, when equipped with an electric motor, is easier to maintain than a butane-operated one. However, for the grower who might not have electric power available for electric motor, the butane-fueled engine may be more desirable and lends itself to the portability of the system of the present invention since there are no power lines involved in setting the system up and butane might also then be used as the fuel supply for the burners.

In operating the equipment illustrated in FIGS. 1, 2 and 3, practicing the methods of the present invention, the grower or farmer loads palletts of sweats into the drying room 10 by means of a skip-loader driving through opened doors 11 and 12 into room 10. Following the loading of approximately 30 palletts, (16 sweats each) into the drying room 10, representing approximately 35 tons of raisins, doors 11 and 12 are closed. A switch (not shown, but well known to those skilled in the art) is then turned to the "on" position which sets the fan into operation. The burners, however, are ignited separately. The burners are then ignited and hot air commences to flow into the room 10 through the ducts 15. A portion of that air pumped into the room 10 is vented through the ports 13*a*–13*h*, which may be adjusted to control the amount of air that is exited through these ports and not returned to the source 14. The air not vented through ports 13*a*–13*h* is sucked out of room 10 through duct 16 and recirculated. This procedure continues for approximately 20 to 24 hours, at the end of which the field-dried raisins that have been placed in the drying room 10 have been reduced in moisture content to 16% or less so that they meet the U.S.D.A. standards. Only 5 persons, typically, are needed to perform these tasks, instead of a regular crew of 22 as are needed in employing the raisin drying method of the prior art. This is principally because the process of putting incoming raisins on drying trays has been eliminated.

Typically, the sweat-loaded palletts within the room 10 are within 1 foot of the front and back walls of the room 10, thus causing the air pumped into the room to accelerate as the air circulates around the sweats. Typically, approximately a pound to 2 pounds of pressure is created by the pumping of the air into the drying room 10.

Figure 1A:
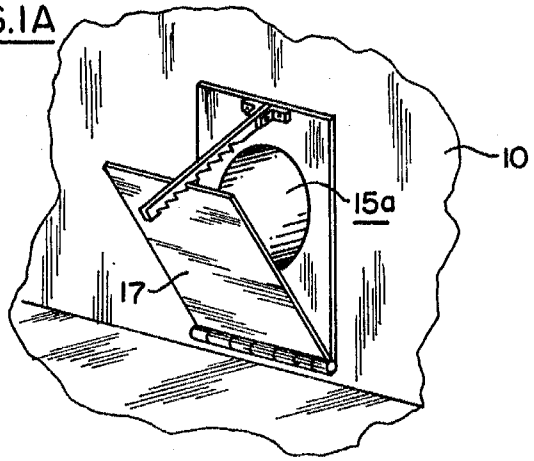
FIG. 1A is a perspective view of a portion of the interior of a drying room included in the fruit drying apparatus of FIG. 1.

Additionally, the damper 17, shown in FIGS. 1A and 3, may be made adjustable from the outside of the room 10 so that, while palletts of sweats are loaded into the room 10, the dampers can be closed. When the room is fully loaded, the dampers 17 may then be opened.

Figure 4:
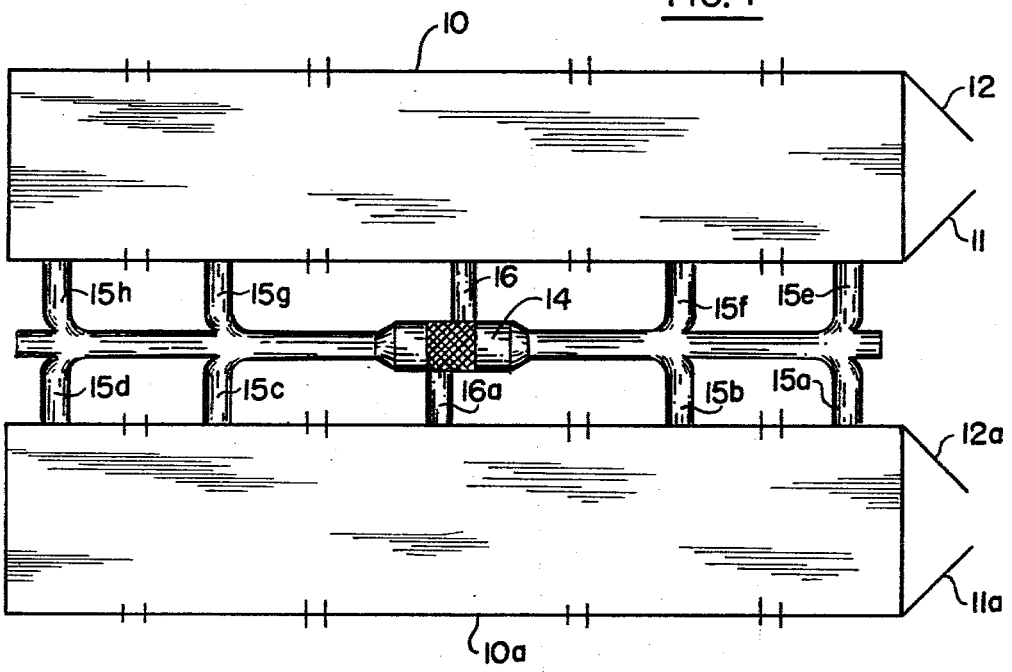
FIG. 4—is a plan view of an alternate embodiment of the fruit drying apparatus illustrated in FIG. 1.

Illustrated in FIG. 4, there is shown 2 drying rooms 10 and 10*a* placed side-by-side and connected to the same source 14 by ducts 15*a*, 15*b*, 15*c*, 15*d*, 15*e*, 15*f*, 15*g* and 15*h* and 16*a* and 16*b*. A single source 14, as illustrated in FIG. 4, may provide 2 drying rooms 10 with sufficient air to accomplish the method of the present invention. Obviously, however, in such system, this system 14 might have twice the air-delivery capacity. In principle, however, its operation would be substantially similar to the embodiment of the invention illustrated and described in connection with FIGS. 1, 2 and 3.

In FIG. 5, is illustrated an end view of the apparatus shown in FIG. 4.

Typical operating temperature of the systems illustrated in the drawings is about 150° for field-dried raisins. At such temperature, the raisins within the sweats contained within room 10 are typically at a temperature of 120°. After 24 hours the moisture within the raisins which have been at 120° fahrenheit is typically 15% to 16% by weight.

While particular embodiments of the present invention have been described and shown, the method and apparatus of the present invention may be mechanized by those skilled in the art in various ways without departing from the spirit and scope of the invention. Accordingly, it is clear that this description is not intended to limit the present invention to the details of construction set forth, but, instead, the invention embraces such changes, modification and equivalents of various parts and their relations as come within the purview of the appended claims.

What is claimed is:

1. Apparatus for use in drying fruit comprising: a housing having side walls, a bottom and a top, and forming an elongated drying room; doors at at least one end of the housing which may be opened to permit stacks of containers of the fruit to be placed in the drying room, and which may be closed to cause the drying room to be enclosed; and means in the drying room to support the stacks with the containers in each stack being spaced vertically with respect to one another, and with the stacks being spaced from the side walls and from the top of the housing, said housing defining a series of exhaust ports extending along at least one of the sides thereof adjacent to said top, and said housing further defining a series of inlet ports extending along one of the side walls thereof adjacent to said bottom; a heat source; a fan for drawing hot air from the heat source; a plurality of ducts each directly coupling the fan to said inlet ports so as to introduce hot air to the interior of the drying room to heat the interior of the drying room above a predetermined temperature threshold at a substantially uniform temperature throughout the room; a damper positioned at each of the inlet ports to deflect the hot air entering the drying room from the inlet ports upwardly between the stacks of containers in the drying room and the corresponding side wall of the housing towards said top, said hot air passing between the top of the stacks of containers in the room and the top of the housing, and down between the stacks of containers in the room and the opposite side wall of the housing; means defining a recirculating port in said first-named side wall; and a duct coupling the recirculating port to an inlet of said heat source, wherein said fan draws the air from said opposite side wall between the individual containers in the stacks and across the fruit within the containers and back to the inlet of said source.

* * * * *